US005260679A

United States Patent [19]

Viscogliosi

[11] Patent Number: 5,260,679

[45] Date of Patent: Nov. 9, 1993

[54] FUSE CARTRIDGE OF THE TYPE WITH FUNCTIONING INDICATOR

[75] Inventor: Joël Viscogliosi, Brindas, France

[73] Assignee: Ferraz, Lyon, France

[21] Appl. No.: 992,689

[22] Filed: Dec. 21, 1992

[30] Foreign Application Priority Data

Dec. 19, 1991 [FR] France ..... 91 16143

[51] Int. Cl.[5] ..... H01H 85/30

[52] U.S. Cl. ..... 337/244; 337/267

[58] Field of Search ..... 337/244, 241, 267, 265

[56] References Cited

U.S. PATENT DOCUMENTS 3,593,246 7/1971 Ferraz ..... 337/244

FOREIGN PATENT DOCUMENTS 1007417 8/1964 United Kingdom ..... 337/244

*Primary Examiner*—Harold Broome

*Attorney, Agent, or Firm*—Dowell & Dowell

[57] ABSTRACT

Fuse cartridge, of the type comprising, a striking element (8) retained against elastic means (7) by a conductive wire (6) connected between the connection heads (2) in parallel with at least one meltable element (5) so as to melt with the latter under the effect of an accidental overintensity, a micro-switch (9) whose knob (12) is intended to be actuated by said striking element to supply an alarm circuit in the case of melting of element (5), characterized in that, between the knob (12) and the striking element (8) there is interposed a rocking lever (13) profiled in the manner of a cam in order to give the micro-switch (9) two stable positions of functioning, whatever its inner mechanism.

4 Claims, 2 Drawing Sheets

FUSE CARTRIDGE OF THE TYPE WITH FUNCTIONING INDICATOR

The present invention relates to fuse cartridges intended for the protection of electrical circuits and it concerns more particularly those which are equipped with a functioning indicator adapted permanently to inform on the state of the fuse or fuses incorporated.

It is known that the body of cartridges of this type generally comprise an insulating envelope which is closed by lateral connection heads provided with connection knives and which contains a mass of siliceous matter within which is embedded at least one meltable element connected to said heads. In parallel with this fuse, there is additionally provided between the heads a conductive wire of much reduced section which retains, against a spring or other elastic means, a striking element mounted in a cavity made in the envelope, which striking element, when it is released, is adapted to act against the actuation knob of a micro-switch connected to the supply of an alarm circuit.

It will be appreciated that, in normal operation, the whole of the current is conveyed by the fuse, with the result that the striking element, maintained by its conductive wire, is in the retracted position. On the contrary, in the event of accidental overintensity, the fuse and the conductive wire are destroyed by melting, with the result that, under the effect of its spring, the striking element actuates the micro-switch and the alarm circuit which is associated therewith.

This arrangement is well known in the art and has been described in detail in particular in French Patent No. 1 560 404 of Dec. 26, 1966 in the name of LUCIEN FERRAZ ET CIE.

It goes without saying that, if it is intended to obtain maximum safety of use, the alarm circuit should be maintained supplied for as long as the operator has not replaced the meltable cartridge and re-set the striking element. In practice, one must thus resort to micro-switches of the bistable type which comprise a position of rest and a position of functioning, the passage from one to the other being effected by means of a fleeting pressure on the actuation knob.

Now, micro-switches of the bistable type present much larger dimensions and clearly much higher cost than those of the monostable type. In addition, their functioning most often involves a more accentuated effort of actuation, which results in associating with the striking element a more powerful thrust spring and a retaining conductive wire of larger section.

It is a principal object of the present invention to overcome these drawbacks, and this by arranging the cartridge so that it is capable of being provided with a monostable micro-switch adapted to function in the manner of a bistable micro-switch.

To that end, the invention essentially consists in interposing between the striking element and the actuation knob of the micro-switch an intermediate lever which, due to its cam-shaped profile, is adapted to take two stable positions and thus to give to the actuation knob the two stable positions desired.

The accompanying drawing, given by way of example, will enable the invention, the characteristics that it presents and the advantages that it is capable of procuring, to be more readily understood.

Figure 1:
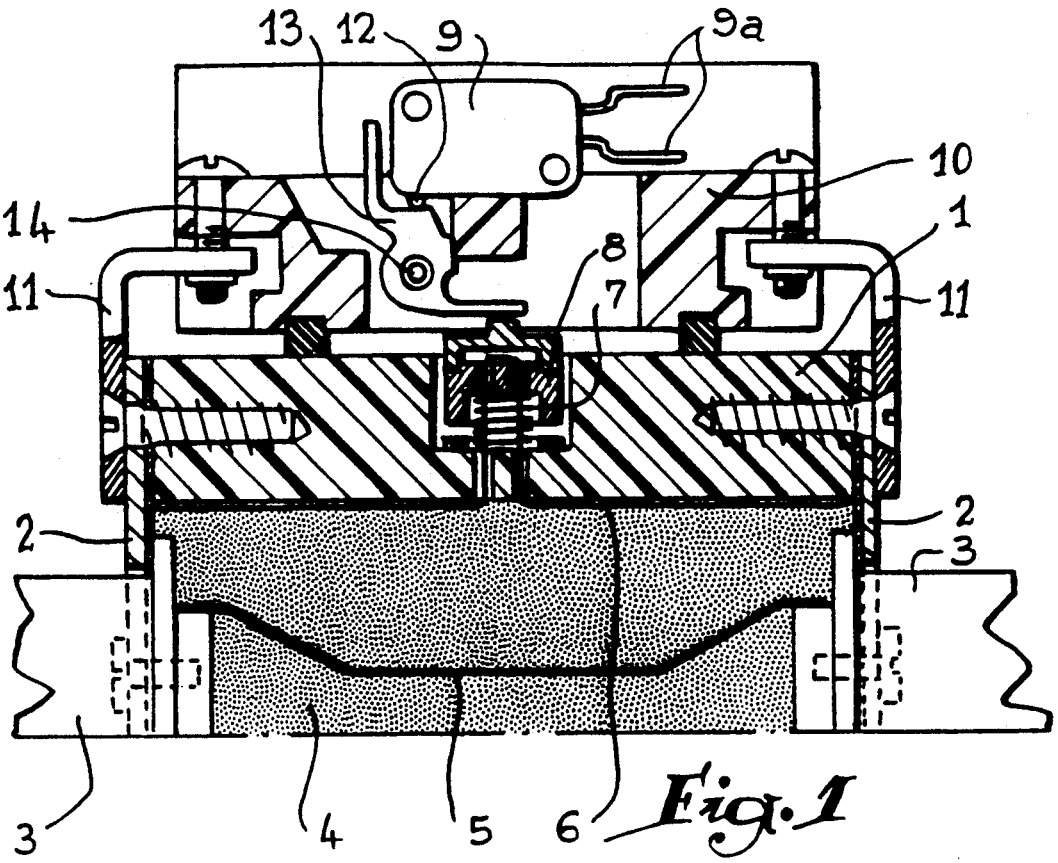
FIG. 1 shows, in axial half-section, the general arrangement of a fuse cartridge according to the present invention.

In its general arrangement, the cartridge in question is similar to that described in detail in French Patent No. 1 560 404 mentioned above. There is found an insulating envelope 1, closed laterally by two connection heads 2 of which each is provided with a connection knife 3. The space thus defined by the body 1-2 contains a siliceous mass 4 in which is embedded at least one meltable blade 5 whose ends are rendered fast with the heads 2. The latter are in addition connected to one another by a conductive wire 6 of highly reduced section, which follows the inner wall of the envelope 1 and which is shaped to determine a central loop adapted to retain, against its spring 7, a striking element 8 mounted to slide in a lateral cavity in said envelope. With this striking element 8 is associated a micro-switch 9 borne by an insulating support 10 fixed to the body 1-2 by two small lateral square brackets 11, which micro-switch ensures control of an electrical alarm circuit connected to its terminals 9.

Whereas in the conventional construction the striking element 8, once released by melting of the conductive wire 8, acts directly against the actuation knob 12 of the micro-switch 9, according to the invention, there is interposed between said striking element and knob a rocking lever 13 profiled in the manner of a cam.

Figure 2:
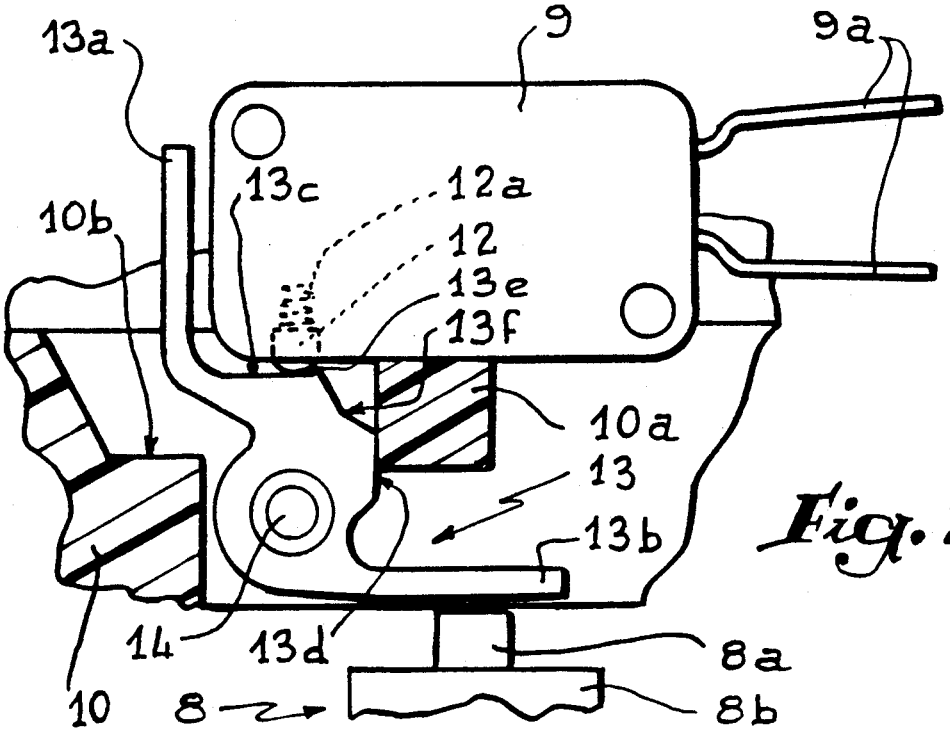
FIGS. 2, 3 and 4 illustrate on a larger scale the structure and functioning of the functioning-indicator system of the cartridge according to FIG. 1.

As is particularly visible in FIG. 2, the support 10 is largely hollowed out and supports in its hollow a fixed transverse pin 14 on which the lever 13 is idly mounted. The latter, provided with two arms **13*a* and 13*b* oriented perpendicularly to each other, is profiled in its central part to present two bearing surfaces 13*c* and 13*d*, themselves oriented square. The arm 13*b* is disposed immediately above the central boss 8*a* of the conventional cap 8*b* which covers the striking element 8, whilst part 13*c* forms bearing for the actuation knob 12 urged by elastic means 12*a* incorporated in the micro-switch 9**.

When the cartridge has an electrical current passing therethrough whose intensity is less than nominal, the parts are in the standby position illustrated in FIG. 2. The lever 13 whose profile is such that it is substantially in equilibrium on its pin 14, is retained in this position by the friction resulting from the pressure exerted by the knob 12 against the bearing surface **13*c*; the bearing surface 13*d* is in abutment against a crosspiece 10*a* of the support 10. If the effect of the vibrations capable of being imparted to the cartridge is feared, this retaining may be improved either by providing a relief or tooth 13*e* at the end of the bearing surface 13*c*, or by offsetting the pin 14 with respect to the vertical axis of the actuation knob 12**.

Figure 3:
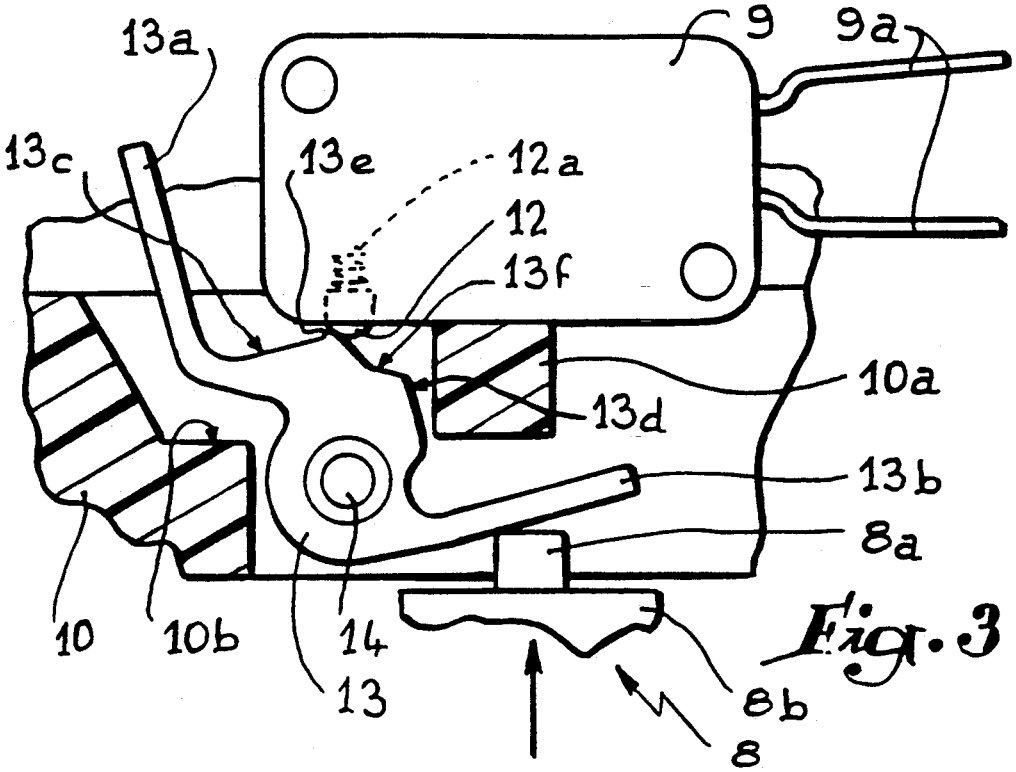
Figure 4:
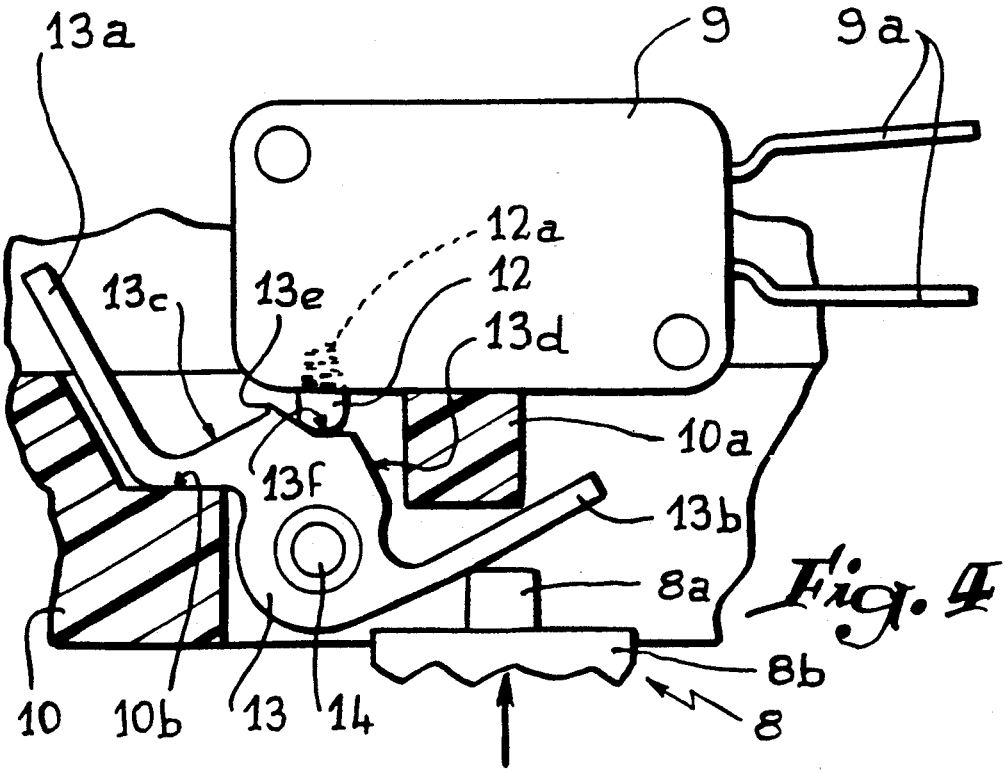

The release of the striking element 8 under the effect of simultaneous melting of the meltable blade 5 and of the retaining wire 6 provokes the displacement of the striking element 8 under the action of its spring 7 and an effect of thrust against the arm **13*b* of the lever 13, which rocks in the manner illustrated in FIG. 3 until it takes the position of signalization shown in FIG. 4. The knob 12 slides downwardly under the effect of its spring 12*a* with the result that the microswitch 9 controls the alarm circuit connected to its terminals 9*a***.

This position is perfectly stable, even if it is assumed that, for any reason, the boss **8*a* of the cap 8*b* of the striking element 8 ceases its action of thrust against the arm 13***b*. In fact, the knob 12, urged by its spring 12*a*, exerts its action against a profiled ramp 13*f* provided on the lever 13 between the bearing surfaces 13*c* and 13*d*, with the result that, in any case, said lever is maintained applied against a bearing 10*b* made to that end in the support 10.

It should be observed that, in addition to the electrical alarm circuit thus started, the functioning of the cartridge is rendered visible from the outside, as the 13*a* of the lever 13*d* has left the position according to FIG. 2 for which it was applied against the wall of the micro-switch 9, to take the oblique position in projection illustrated in FIG. 4.

It will be understood in any case that the inner mechanism of the micro-switch 9 may be absolutely any one, particularly of the bistable type, since it is the intermediate lever or cam 13 which gives the actuation knob 12 two perfectly stable positions.

It goes without saying that, to reset the micro-switch 9 after replacement of the fuse cartridge, it suffices to maneuver the lever 13 manually to pass it from the position of FIG. 4 to that according to FIG. 2.

It must, moreover, be understood that the foregoing description has been given only by way of example and that it in no way limits the domain of the invention which would not be exceeded by replacing the details of execution described by any other equivalents. In particular, it is imagined that the lever 13 may be provided to be sufficiently wide to ensure, alone, the actuation of two micro-switches 9, mounted side by side on the insulating support 10.

I claim:

1. Fuse cartridge, of the type comprising a striking element (8) retained against elastic means (7) by a conductive wire (6) connected between connection heads (2) in parallel with at least one meltable element (5) so as to melt with the latter under the effect of an accidental overintensity, a micro-switch (9) of which a the knob (12) is intended to be actuated by said striking element to supply an alarm circuit in the case of melting of the element (5), characterized in that, between the knob (12) and the striking element (8), there is interposed a rocking lever (13) profiled in the manner of a cam in order to give the micro-switch (9) two stable positions of functioning, whatever its inner mechanism.

2. Cartridge according to claim 1, characterized in that the lever (13) comprises two bearing surfaces (13*c* and 13*d*) oriented at 90° with respect to each other and arranged so as to form bearings, one (13*c*) for the knob (12) in a standby position, the other (13*d*), against a fixed cross piece (10*a*) with a view to limiting the angular displacement of said lever and thus to define the standby position, these two bearing surfaces being joined to each other by a ramp (13*f*) forming bearing for the knob (12) when the lever has rocked into position of signalization.

3. Cartridge according to claim 2, characterized in that, between the ramp (13*f*) and the corresponding end of the bearing surface (13*c*), the lever (13) presents a relief or tooth (13*e*) adapted to ensure a better retaining of said lever in the standby position.

4. Cartridge according to claim 1, characterized in that the lever (13) comprises two opposite arms of which one (13*b*) is shaped to receive the action of the striking element (8) whilst the other (13*a*) forms a signalization member ensuring visualization of the state of the meltable element (5).

* * * * *